United States Patent [19]

Ervin et al.

[11] 4,274,191

[45] Jun. 23, 1981

[54] METHOD AND APPARATUS FOR GAPPING WOVEN SLIDE FASTENER STRINGER HAVING ELEMENTS MOUNTED ON LONGITUDINAL MEMBER IN EDGE OF TAPE

[75] Inventors: James K. Ervin, Meadville; Nicholas L. Salamon, Linesville, both of Pa.

[73] Assignee: Textron, Inc., Meadville, Pa.

[21] Appl. No.: 40,790

[22] Filed: May 21, 1979

[51] Int. Cl.[3] ..... B23P 19/04; B26D 1/06

[52] U.S. Cl. ..... 29/408; 29/770

[58] Field of Search ..... 29/408, 410, 426, 427, 29/766, 770, 33.2; 83/921

[56] References Cited

U.S. PATENT DOCUMENTS

| | | | |
|---|---|---|---|
| 3,540,090 | 11/1970 | Takamatsu | 29/408 X |
| 3,611,545 | 10/1971 | Takamatsu | 29/408 |
| 3,711,930 | 1/1973 | Potin | 29/408 |
| 3,831,474 | 8/1974 | Perlman | 83/921 X |
| 4,091,532 | 5/1978 | MacFee | 29/770 |
| 4,131,223 | 12/1978 | Aureli | 83/921 X |

*Primary Examiner*—Ervin M. Combs

*Attorney, Agent, or Firm*—O'Brien and Marks

[57] ABSTRACT

Slide fastener elements, mounted on a longitudinal support member woven in the edge of a tape, are removed by cutting the longitudinal support member on each side of each fastener element and pulling the tape longitudinally between opposed biased blades engaging the elements to strip the fastening elements from the tape.

8 Claims, 17 Drawing Figures

FIG. 1
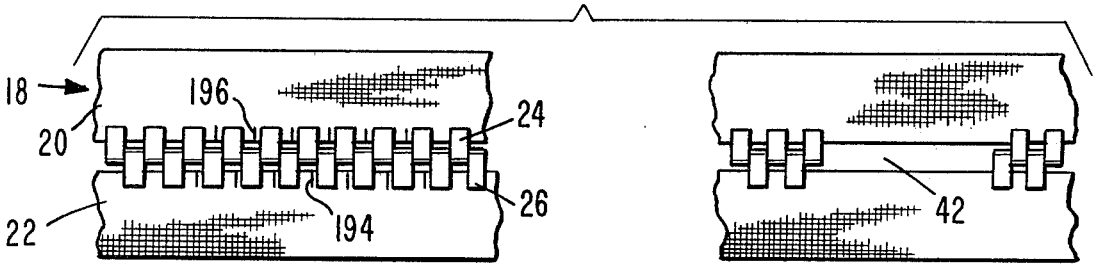
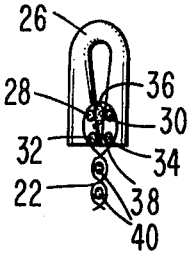
FIG. 2
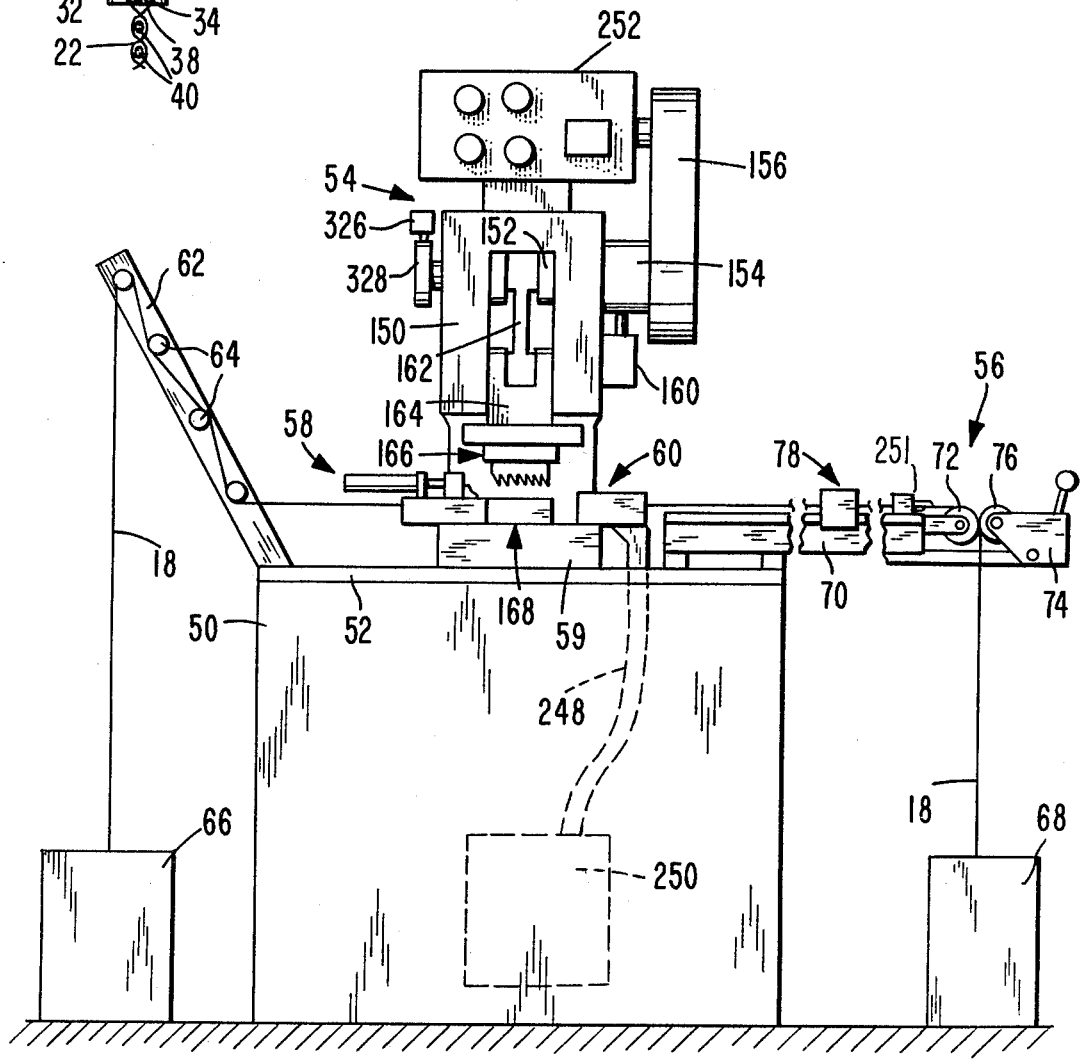
FIG. 3

FIG.10
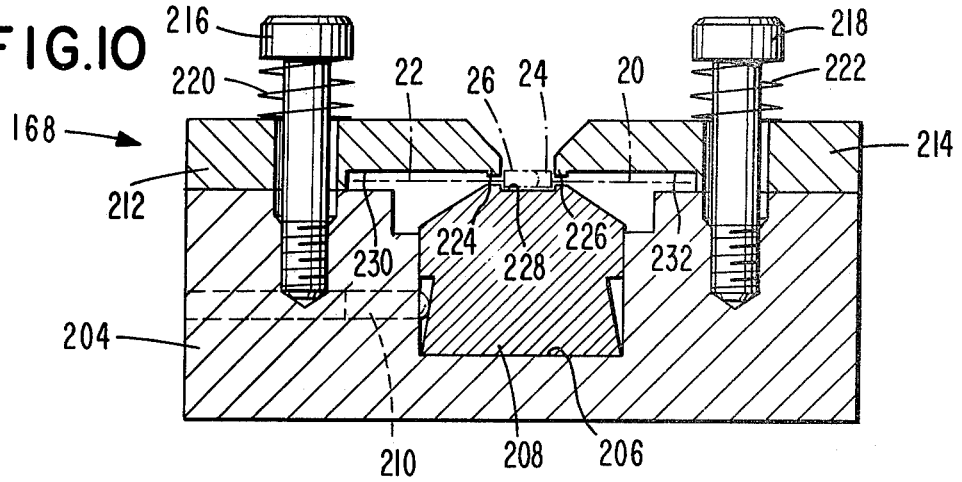
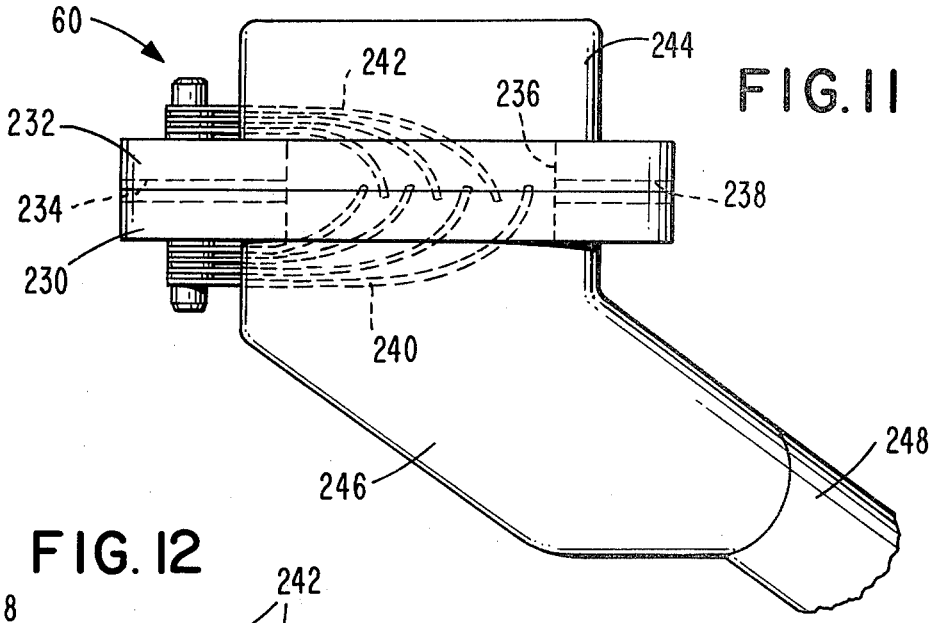
FIG.11
FIG. 12
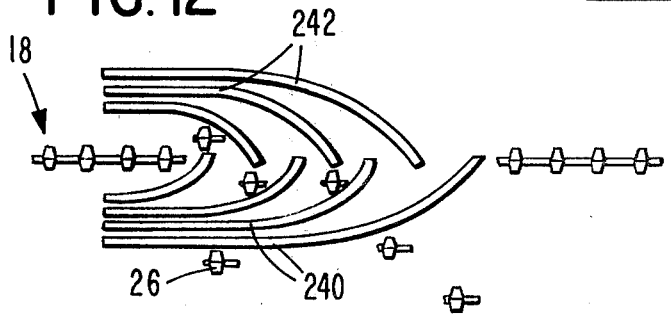
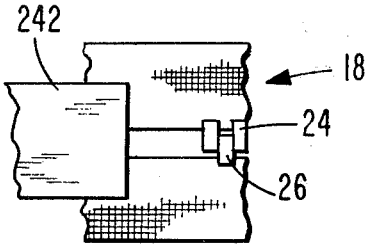
FIG. 13
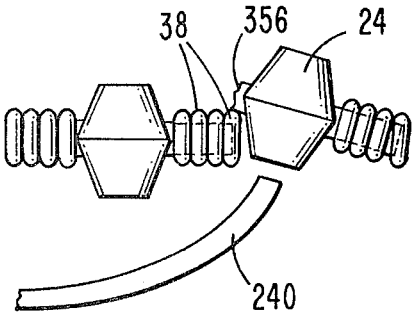
FIG. 14

METHOD AND APPARATUS FOR GAPPING WOVEN SLIDE FASTENER STRINGER HAVING ELEMENTS MOUNTED ON LONGITUDINAL MEMBER IN EDGE OF TAPE

TECHNICAL FIELD

This invention relates to methods and apparatus for removing fastening elements from sections of slide fastener tapes, and particularly, to removing elements which are mounted on longitudinal load-carrying support members such as cords, threads or the like secured to the edge of the tape by loop segments of weft thread passing over the support members between the fastening elements.

BACKGROUND ART

In the manufacture of slide fasteners having fastening elements molded onto longitudinal support cords or threads woven to the edge of the slide fastener tapes, gaps in the fastening elements are usually produced by severing only the head portions of the fastening elements leaving the leg portions attached to the tapes. The remaining segments of leg portions can be irritating to skin contacting the slide fastener, are difficult to sew across when attaching to a garment and tend to become jammed in a slider during movement of the slider.

The prior art, as exemplified in U.S. Pat. Nos. 3,540,090, 3,611,545, 3,711,930 and 4,131,223, contains a number of methods and apparatus for gapping a slide fastener wherein the fastening elements are completely removed from the sections of slide fastener tapes being gapped. However, the prior art methods and apparatus are employed for gapping different types of slide fasteners than the present woven type of slide fastener wherein the elements are molded on a longitudinal supporting member woven in the edge of a tape; such prior art methods and apparatus are unsuitable for completely removing the elements from slide fastener tapes with the elements mounted on a longitudinal support member woven in the tape.

SUMMARY OF THE INVENTION

The invention is summarized in a method of gapping a slide fastener stringer which has a woven tape and a plurality of spaced fastening members secured on a longitudinal support member which is secured in the edge of the tape by parallel weft thread segments of the tape extending around the support member between the fastening elements, the method including the steps of severing the longitudinal member in the spaces between fastening elements on each side of each of a group of the fastening elements, and pulling the slide fastener stringer longitudinally between opposed biased blades engaging the elements to strip the group of fastening elements from the tape.

An object of the invention is to develop a procedure and construct an apparatus for completely removing fastening elements from selected sections of slide fastener tapes wherein the fastening elements are mounted on a longitudinal support member woven in the edge of the tape.

Another object of the invention is to remove fastening elements from selected sections of slide fastener tapes without cutting weft threads securing a longitudinal support member for the elements and without cutting warp threads not directly connected with the fastening elements.

One advantage of the invention is that a group of slide fastener elements having a longitudinal supporting member cut on opposite sides of each of the elements are removed during a advancing step for the slide fastener stringer by passing the stringer elements between blades on opposite sides of the stringers to thus form a single combined stringer advancing and severed element removing step.

Other objects, advantages and features of the invention will be apparent from the following description of the preferred embodiment taken in conjunction with the accompanying drawings.

BRIEF DESCRIPTION OF THE DRAWINGS

FIG. 1 is a plan view of a length of slide fastener chain, with portions broken away, illustrating the chain at two different steps during the forming of a gap in the fastening elements in accordance with the method and apparatus of the invention.

FIG. 2 is a cross-section view of a portion of one stringer or half of the slide fastener chain of FIG. 1.

FIG. 3 is a front elevational view of an apparatus for gapping a slide fastener chain in accordance with the invention.

FIG. 10 is a side cross-sectional view of the die assembly shown in FIG. 8.

FIG. 11 is a front elevational view of an element removing mechanism in the apparatus of FIG. 2.

FIG. 12 is a detailed view of a plurality of stripping blades of the mechanism of FIG. 10 particularly illustrating the removing of the elements from an advancing chain.

FIG. 13 is a plan view of a portion of a stripping blade shown in FIG. 11.

FIG. 14 is an enlarged elevation view of a portion of the element removing mechanism of FIG. 10 particularly illustrating a beginning operation in the removal of an element.

DESCRIPTION OF THE PREFERRED EMBODIMENTS

Figure 4:
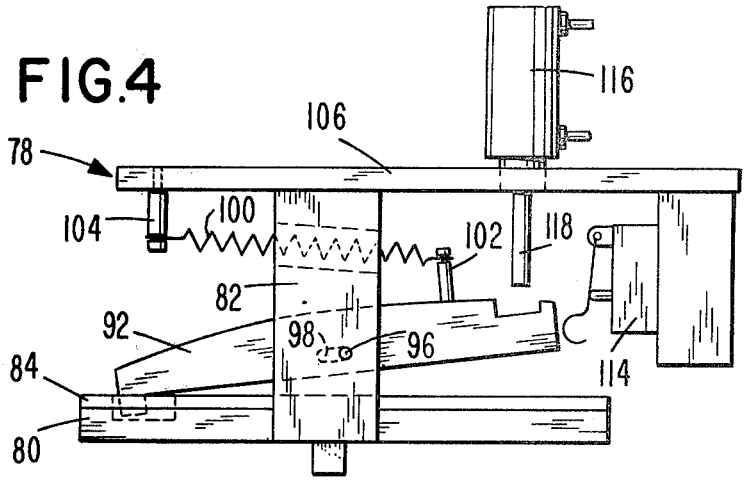
FIG. 4 is a front elevation view of a gap sensing mechanism of the apparatus of FIG. 2.

As shown in FIG. 1, a slide fastener chain 18 for being gapped in accordance with the invention includes a pair of tapes 20 and 22 having respective rows of fastening elements 24 and 26 secured to inner edges of the tapes 20 and 22. As illustrated for the fastening elements 26 in FIG. 2, the fastening elements are mounted on one or more longitudinal supporting members such as longitudinal connecting threads 28, 30, 32 and 34 wherein the threads 28 and 32 are embedded in one leg of the fastening elements 26 and threads 30 and 34 are embedded in the other leg of the fastening elements 26. Additionally a longitudinally extending invested cord 36 may be sandwiched between the leg portions of the fastening elements 26 between the threads 28 and 30, and molded projections (not shown) may be formed to extend in opposite directions from the respective leg portions of each fastening element along the threads 30 and 34 to overlap and cooperate with projections from the immediate adjacent elements to further strengthen and increase the stability of the longitudinal connecting means joining the fastening elements 26 together. The tape 22 has a plurality of weft or filler thread segments 38 extending around the longitudinal connecting and supporting members for the fastening elements 26 in the space between each pair of adjacent fastening elements. Preferably the weft thread is a non-twisted multifilament thread, but the weft thread may be a twisted multifilament thread. The tapes 20 and 22 are formed in a tape weaving loom wherein the trains of fastening elements 24 and 26 interconnected by the longitudinal support members are fed as respective edge warp members in a conventional manner as employed in forming other types of woven slide fastener chains. It is noted that the weft thread segments 38 extend parallel each other between the fastening elements perpendicular to the tapes and that the warp threads 40 of the tapes which are not directly joined with the fastening elements do not overlie the fastening elements but rather extend side-by-side in the tapes from the heel edges of the fastening elements. The tape 20 with attached row of fastening elements 24 forms one stringer of the slide fastener chain while the tape 22 and fastening elements 26 form another stringer for the slide fastener chain.

An apparatus for forming gaps 42 in the slide fastener chain at selected points along the lengths of the slide fastener chain is illustrated in FIG. 3. This apparatus includes a base or support 50 upon which is mounted a table top 52 carrying a press or cutting mechanism indicted generally at 54 and a slide fastener chain pulling mechanism indicated generally at 56. A fine positioning mechanism indicated generally at 58 is mounted on the left side of a base 59 of the cutting mechanism 54 and a fastening element stripping mechanism indicated generally at 60 is mounted on the right side of the base 59 of the mechanism 54 between the cutting mechanism 54 and the pulling mechanism 56. A guide member 62 is mounted on the left end of the table 54 and has a plurality of pulleys 64 over which the slide fastener chain 18 is directed from a supply means, such as a box 66, to the fine positioning mechanism 58. After gapping, the chain 18 is directed from the pulling mechanism 56 to a similar take-up means such as a box 68.

Figure 5:
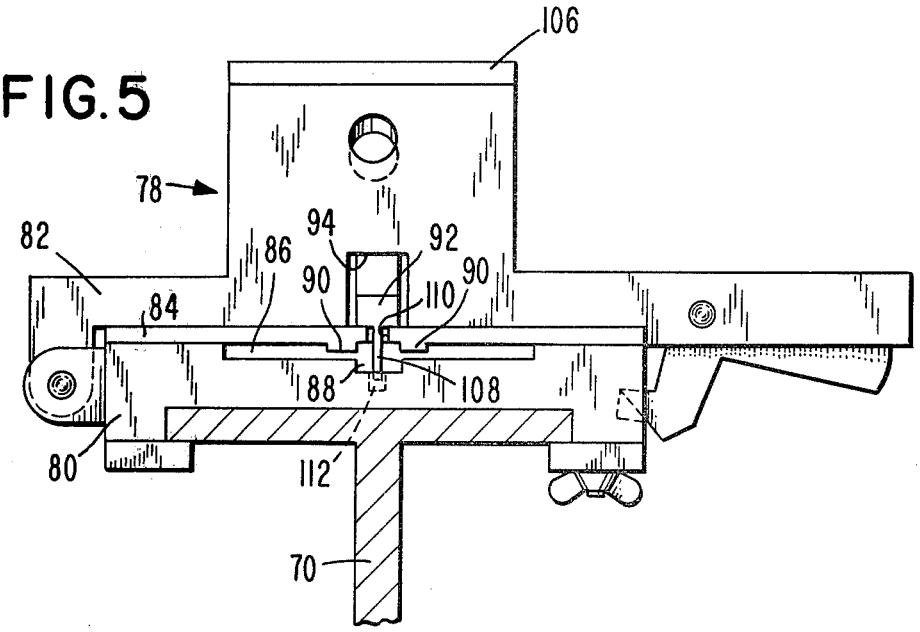
FIG. 5 is a side view taken from the left of the sensing mechanism of FIG. 3.

The pulling mechanism 56 includes a rail 70 having a T-shaped cross-section, see FIG. 5, which extends a suitable length from the cutting mechanism 54 to accommodate a maximum length of the chain 18 between gaps 42. A pulley 72 coupled by a clutch 71, FIG. 15, to a motor 73, FIG. 15, is supported at the distal end of the rail 70 along with a manually pivoted carriage 74 supporting a pinch roller 76 for releasably gripping the slide fastener chain 18 between the rollers 72 and 76.

A gap sensing mechanism indicated generally at 78 is adjustably secured to the rail 70 at a selected position along the length thereof, corresponding to the desired length of chain 18 between gaps 42. As shown in FIGS. 4 and 5, the sensing mechanism 78 includes a lower plate 80 which can be releasably clamped to the upper portion of the rail 70. A carrier member 82 is pivoted at the back of the lower plate 80 and releasably latched to the front of the lower plate 80. An upper plate 84 is mounted on the bottom of the member 82 for engagement against the upper surface of the lower plate 80. A channel 86 is formed in the upper surface of the plate 80 with a deeper central portion 88 for receiving the slide fastener chain 18 with the fastening elements 24 and 26 interlocked. Ribs 90 on the upper plate 84 extend downward into the channel 86 on opposite sides of the channel portion 88 to thus form a central passageway for guiding and centrally restricting the interlocking fastening elements of the chain 18 in the channel portion 88. A lever 92 extends horizontally through an opening 94 in the bottom central portion of the carrier member 82 over the plate 84 and is slidably and pivotally mounted on the member 82 by means of a pin 96 which extends through a horizontal slot 98 formed in the member 92. A tension spring 100 is mounted at its right end on a pin 102 on the lever 92 to the right of the pivot 96 and is attached at its left end to a pin 104 mounted on a carrier plate 106 secured to the top of the carrier member 82. The spring 100 extends upward and to the left from the pin 102 through a bore in the carrier member 82 so as to bias the lever 92 counterclockwise and to the extreme left position relative to the sliding pivot 96. A blade-like projection or tang 108 extends downward from the left end of the lever 92 for extending through a slot 110 in the left center portion of the upper plate 84 and through the central portion 88 of the channel 86 into a small groove 112 formed in the bottom of the channel portion 88. An electrical switch 114 is mounted adjacent the right end of the lever 92 for being engaged and operated by the lever 92 when the lever 92 is forced to its rightmost position. An air cylinder 116 is mounted on the carrier plate 106 above the right end of the lever 92 and has a downward extending piston rod 118 for engaging the lever 92 to pivot the lever 92 and raise the projection 108 from the passageway 86.

Figure 6:
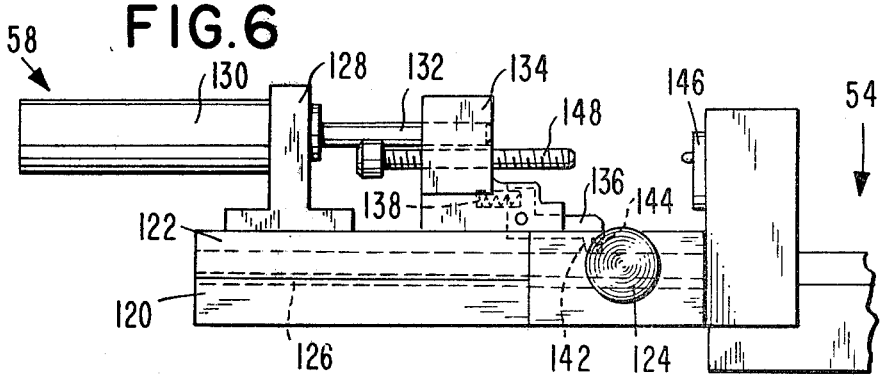
FIG. 6 is a front elevation view of a fine positioning mechanism of the apparatus of FIG. 2.
Figure 7:
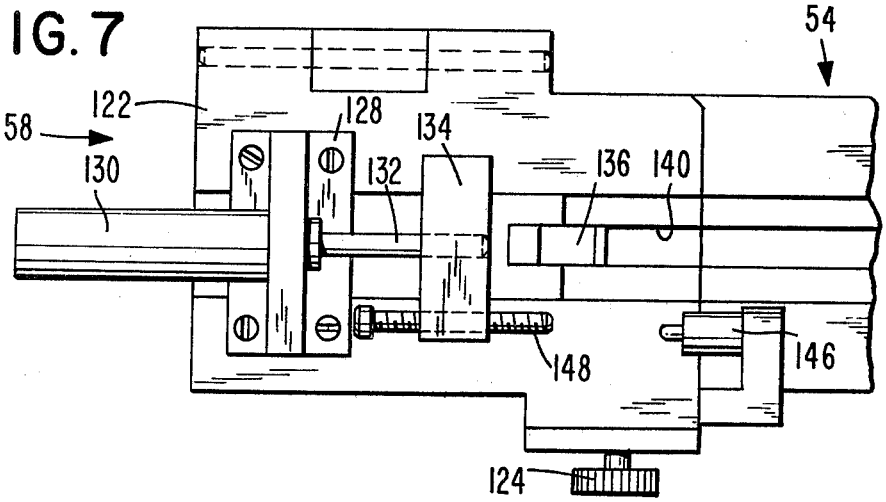
FIG. 7 is a plan view of the fine positioning mechanism of FIG. 6.

The fine positioning mechanism 58, as shown in FIGS. 6 and 7, includes a lower plate member 120 upon which an upper plate member 122 is hinged at the rear edges thereof. A screw lock 124 is provided for securing the upper plate member 122 in a closed position with the lower plate member 120. A channel 126, similar to the channel 86 of FIG. 5, is provided in the mating faces of the plates 120 and 122 for directing the slide fastener chain from the pulleys 62 to the cutting mechanism 54. A bracket 128 mounted on the upper plate 122 supports an air cylinder 130 which has a piston rod 132 upon which is mounted a carriage 134. A pawl 136 is pivotally mounted at its left end on the carriage 134 and is biased by a compression spring 138 to urge its right end downward into a slot 140 cut through the right end of the upper plate member 122 to expose the locking elements 24 and 26 of the slide fastener chain. A pair of offset teeth 142 and 144 extend downward from the right end of the pawl 136 for engaging into the interstices between the respective fastening elements 24 and 26. The teeth 142 and 144 have sloping surfaces on their left sides for permitting the pawl 136 to be cammed upward when the slide fastener chain is pulled to the right through the fine positioning mechanism or the carriage 134 is moved to the left relative to the slide fastener chain, and the teeth 142 and 144 have right surfaces shaped to engage the elements 24 and 26 and advance the chain when the carriage 134 is pushed in a downward direction. A switch 146 is mounted to the right of the carriage 134 for being engaged by the end of the adjustable screw 148 extending from the carriage 134 to indicate when the carriage has reached its end of travel. The carriage 134 advances to the end of travel for the piston rod 130; this position can be adjusted by moving the bracket 128 to set the fine position of the slide fastener chain relative to the cutting mechanism 54.

Figure 15:
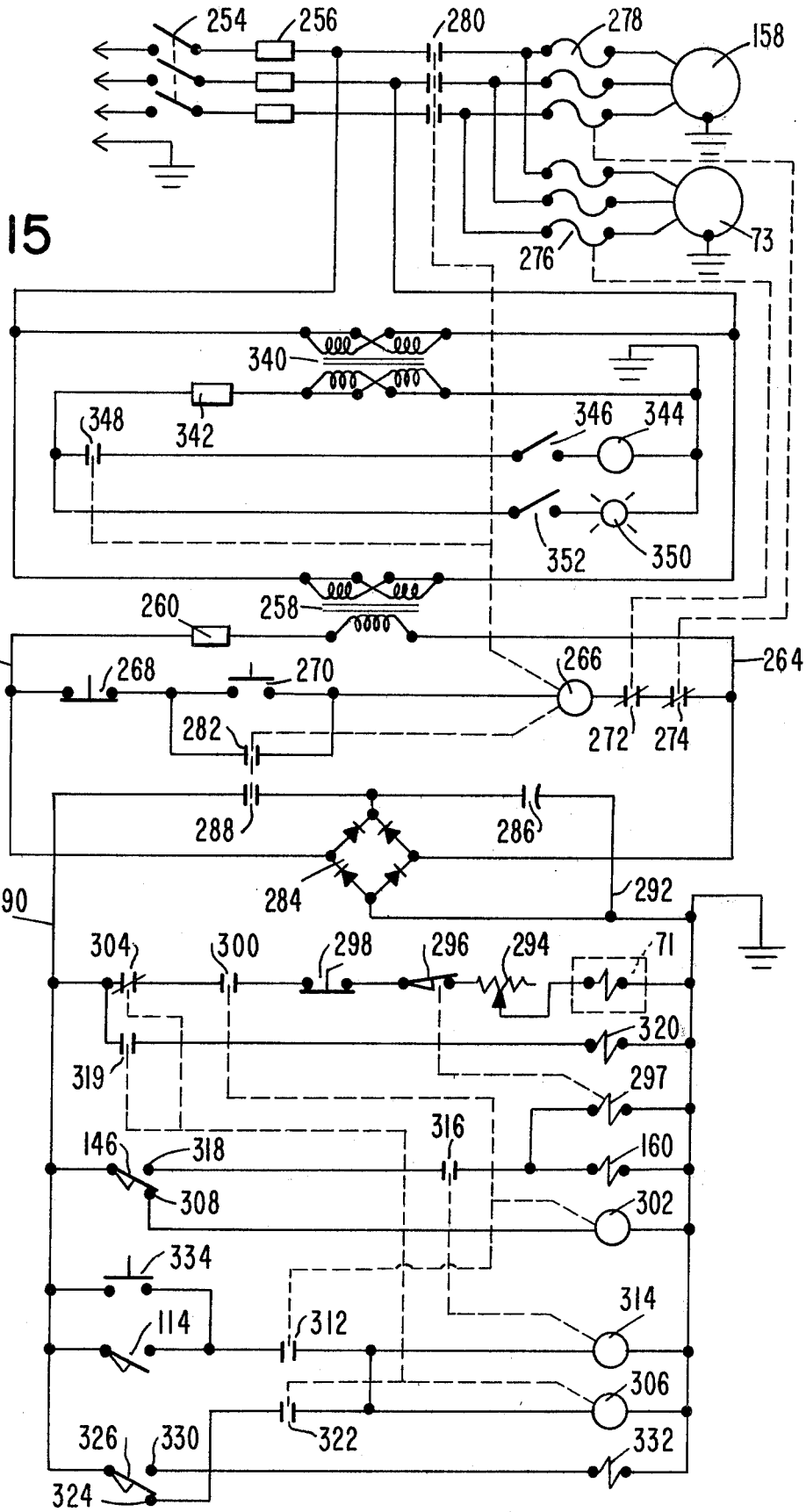
FIG. 15 is a schematic of an electrical circuit for controlling the operation of the apparatus of FIG. 2.

The cutting mechanism 54, as shown in FIG. 3, includes a support 150 extending upward from the base 59 and rotatably supporting a crank 152 which is coupled by a clutch 154 and a belt drive arrangement 156 to a motor 158, FIG. 15. The clutch 154 is operated by a solenoid 160. A rod 162 connects the crank 152 to a ram 164 which is vertically slidable in the support 150. A cutter assembly indicated generally at 166 is mounted on the bottom of the ram 164, and a die assembly indicated generally at 168 is mounted on the top of the base 59 beneath the cutter assembly 166.

Figure 8:
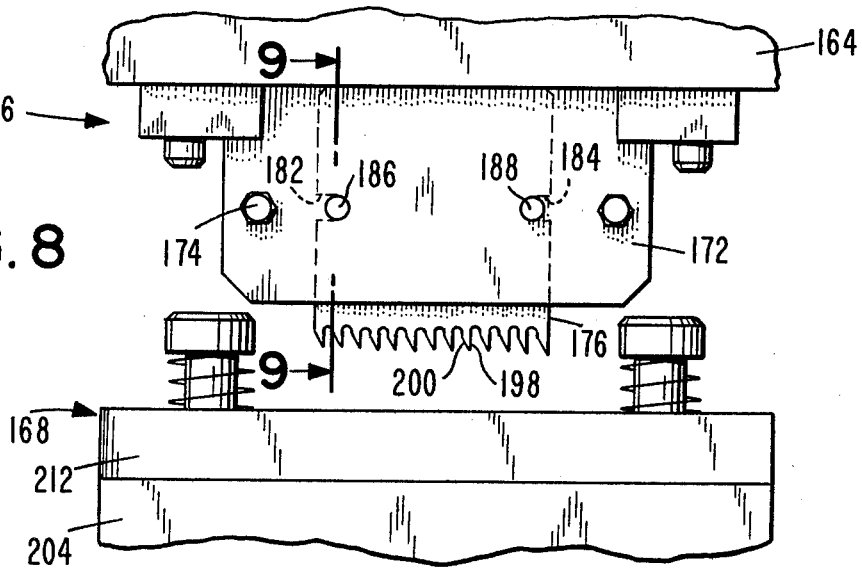
FIG. 8 is a front elevation view of a cutting assembly and top portion of a die assembly in the apparatus of FIG. 2.
Figure 9:
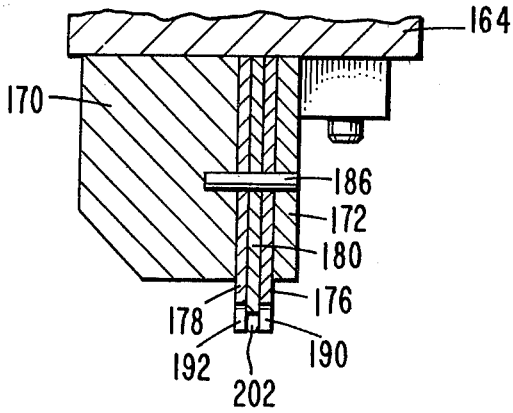
FIG. 9 is a cross-sectional view of the cutting assembly shown in FIG. 8.

As illustrated in FIGS. 8 and 9, the cutter assembly 166 includes a pair of holder members 170 and 172 fastened to the bottom of the ram 164 and secured together by means of bolts 174. Front and back plate-like cutting members 176 and 178 are separated by a plate 180 secured between the members 170 and 172. The cutting plates 176 and 178 and the spacer plate 180 have notches 182 and 184 formed in the sides thereof for receiving respective pins 186 and 188 mounted in the member 170 and extending through an opening in the member 172 for holding the plates 176, 178 and 180 in the members 170 and 172. Pluralities of cutting teeth 190 and 192 are formed on the bottom edges of the respective cutting plates 176 and 178. The cutting teeth 190 on the front plate 176 are offset relative to the teeth 192 on the rear plate 178 so that the cutting teeth 190 and 192 will form cuts at 194 and 196 (FIG. 1) between the leg portions of the respective fastening elements 24 and 26. The fine positioning mechanism 58 is set so that the cuts 194 and 196 are formed adjacent to one of the fastening elements 24 or 26 bordering the space between the pairs of fastening elements in which the cut is being made. The cutting teeth are formed with a vertical side 198 so that the teeth may pass closely to one side of the respective fastening elements 24 or 26. The opposite side of the cutting teeth is formed with a slanting surface 200. The width of the spacer plate 180 is selected to position the cutting blades 176 and 178 over the inner edges of the tapes 20 and 22 and to avoid cutting of the head portions of the elements 24 and 26. The width of the cutting blades 176 and 178 and their respective teeth 190 and 192 is selected to form the cuts 194 and 196 across all of the connecting threads 28, 30, 32 and 34 and the invested cord 36 but to avoid any of the warp threads 40 in the tapes 20 and 22. Also the cutting edges of the teeth 190 and 192 extend perpendicular to the longitudinal dimensions of the tapes 20 and 22 so that the cuts are formed parallel to the weft thread segments 38 between the fastening elements. An elongated elastomeric member 202 is wedged between the teeth 190 and 192 along the bottom edge of the spacer plate 180. This elastomeric member 202 and the bottom edge of the plate 180 are selected so that the member 202 is compressed when the cutting blades 190 and 192 are lowered and the resilience of the member 202 aids in removing the slide fastener chain from the cutting teeth 190 and 192 when the cutting blades are raised.

The die assembly 168 as shown in FIGS. 8 and 10 includes a die holder 204 with a central longitudinal channel 206 containing an elongated die 208 secured by means of set screws 210 in the holder 204. A pair of stripper members 212 and 214 are mounted on the front and back edges, respectively, of the die holder 204 by means of bolts 216 and 218 which have compression springs 220 and 222 urging the stripping members 212 and 214 against the die holder 204. The inner edges of the stripper members 212 and 214 have downward extending ribs 224 and 226 and the upper surface of the die 208 has a channel 228 which in cooperation with ribs 224 and 226 form a passageway for the interlocking fastening elements 24 and 26 of the slide fastener chain to guide and hold the elements 24 and 26 in position below the cutting plates 190 and 192. Channels 230 and 232 are formed in the undersides of the respective members 212 and 214 to receive and pass the tapes 22 and 20 of the slide fastener chain. The bottom surface of the channel 228 of the die 208 is formed to cooperate with the cutting teeth 190 and 192 to cut the longitudinal connecting members supporting the fastening elements 24 and 26 in the slide fastener chain.

Figure 16:
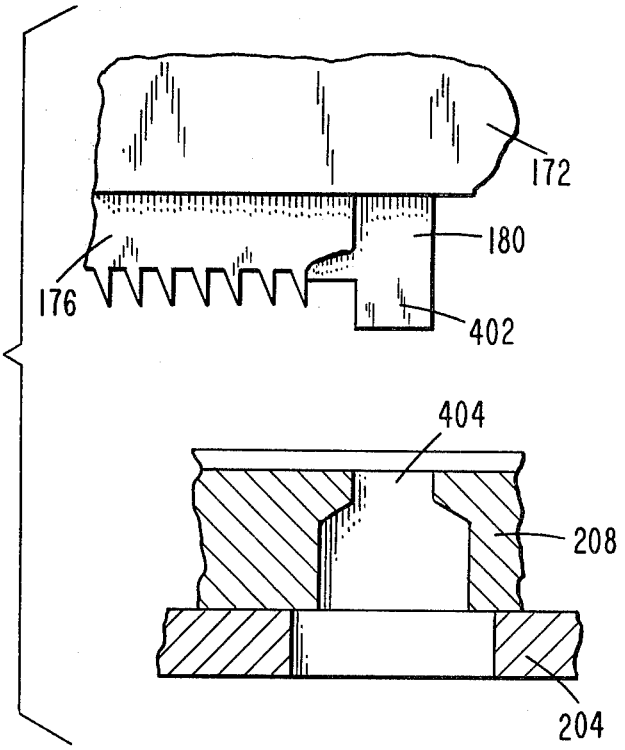
FIG. 16 is a front view, partially in cross-section, of broken away portions of a modified cutting assembly and a modified die assembly in accordance with the invention.

The mechanism 60 for removing the cut elements from the slide fastener chain is illustrated in FIG. 11 and includes a lower member 230 and an upper member 232. Preferably the upper member 232 is hinged to the lower member 230 at the rear with suitable latch means (not shown) provided on the front for latching the members 232 and 230 in the closed position as illustrated in FIG. 11. A passageway 234, similar to the passageway 86 of FIG. 5 is formed in the facing surfaces of the members 230 and 232 from the left edge there to a central opening 236 formed through both of the members 230 and 232 to guide the slide fastener chain into the opening 236. A similar passageway 238 extends from the opening 236 to the right or exit side of the mechanism 60. Four spring blades 240 are mounted at one ends thereof on the member 230 and have their distal ends extending into the opening 236 while three spring blades 242 are mounted at one ends on the member 232 and have their distal ends also extending into the opening 236. More or less of the blades 240 and 242 may be employed. The distal ends of the blades 240 and 242 are arranged in an alternate and spaced relationship so that they engage the fastening elements on the bottom and top as the slide fastener chain is pulled through the mechanism 60. The blades 240 and 242 have a width, as shown in FIG. 16, extending completely across the interlocking fastening elements 24 and 26. The distal ends of the blades 240 and 242 are selected to engage and strip the fastening elements from the slide fastener chain as it is pulled through the mechanism 60. A cover 244, preferably transparent, is mounted on top of the member 232 over the opening 236 while a hopper-like member 246 is mounted underneath the member 230 to connect the opening to a hose 248 which extends to a conventional vacuum device 250, FIG. 3, to collect the elements as they are removed from the slide fastener chain.

An additional stripper mechanism 251 may be mounted on the end of the rail 70 adjacent the pull roller 72 for removing any elements which were not removed by the mechanism 60. The stripping mechanism 251 has a pair of spring stripping blades on respective opposite sides of the slide fastener chain similar to the blades 240 and 242 of FIGS. 11–14. More than one stripping blade on either or both of sides of the slide fastener chain may be employed in the stripping mechanism 251.

A box 252 (FIG. 1) is mounted on top of the press unit 54 and contains at least a portion of an electrical control circuit for controlling the operation of the gapping apparatus. This control circuit, as shown in FIG. 15, includes a power switch 254 for connecting the circuitry to a three-phase power source. Fuses 256 are connected in series with the respective power input lines. Two of the input lines are connected across the primary winding of a step-down transformer 258 such as 220-volt to 24-volt step-down transformer, which has its secondary winding connected in series with a fuse 260 to lines 262 and 264. A winding 266 of a motor-starting relay is connected in a series circuit including a normally closed stop switch 268, a normally open start switch 270 and normally closed contacts 272 and 274 of thermoprotective units 276 and 278; this series circuit is connected across the lines 262 and 264. The relay 266 has normally open contacts 280 connected between the power input and the thermoprotective units 276 and 278 connected in parallel to the respective power inputs of the motors 73 and 158 supplying driving power to the chain pulling mechanism 56 and press 54, respectively. Normally open locking contacts 282 of the motor starting relay 266 are connected across the start switch 270 for holding the motors 73 and 158 in a running condition after the start switch 270 has been released.

A full wave rectifier 284 has its inputs connected to the lines 262 and 264 and its output connected across a filter capacitance 286 and in series with normally open contacts 288 of the motor starting relay 266 to a pair of lines 290 and 292, the line 292 forming a ground or common. The winding of the magnetic clutch 71 in the chain pulling mechanism 56 is connected in a series circuit across lines 290 and 292. This series circuit includes a variable resistance 294, a switch 296 of a predetermined counter, a manual switch 298 which may be set in either the open or closed position, normally open contacts 300 of a relay 302 and normally closed contacts 304 of a relay 306. The variable resistance 294 is set to produce a desired coupling torque of the clutch 71 when the clutch is energized. The switch 296 of the counter 297 opens when the count in the counter reaches zero indicating that a preset count has been counted down. The manual switch 298 is set in the closed position for automatic operation of the apparatus and is set in the open position for manual operation of the apparatus. The switch 146 of the fine positioning mechanism 58 has a contact arm connected to the line 290 and has a normally closed contact 308 connected to one side of the relay winding 302 which has its other side connected to the ground 292. The switch 114 in the gap sensing mechanism 78 is connected in series with normally open contacts 312 of the relay 302 and a parallel arrangement of the relay 306 and a relay 314. The relay 314 has normally open contacts 316 interposed between a normally open contact 318 of the switch 146 and one side of a parallel arrangement of the press tripping solenoid 160 and a winding 297 of the predetermined counter wherein the parallel arrangement is connected at the other side to the ground 292. The relay 306 has normally open contacts 319 connected in series with the winding 320 of a solenoid valve controlling the advancement of the fine positioning air cylinder 130, FIG. 6, and has normally open contacts 322 connected between a normally closed contact 324 of a switch 326 and the junction between the contacts 312 and relays 306 and 314. The switch 326, as shown in FIG. 1, is positioned adjacent a cam 328 which is mounted on the crank arm 152 of the press 54. The cam 328 is contoured to operate the switch 326 momentarily near the end of the cycle of the press 54. The switch 326 has its contact arm connected to the line 290 and its normally open contact 330 connected in series with a solenoid valve 332 controlling the operation of the air cylinder 116 (FIG. 4) in the gap sensing mechanism 78. A normally open push-button switch 334 is connected across the switch 114 to enable manual operation of the apparatus.

Additionally there is shown in FIG. 15 a step-down transformer, such as a 220 volt to 110 volt transformer 340, having its primary winding connected across a pair of the power input lines and having its secondary winding connected in series with a fuse 342. The vacuum device 250 of FIG. 3 has a motor 344 connected in series with a switch 346 and normally open contacts 348 of the motor starting relay 266 across the output of the transformer 340 and fuse 342. A lamp 350 with a switch 352 is also connected across this output for illuminating the work area of the gapping apparatus.

In operation of the apparatus of FIG. 3 to form a gap 42 in the slide fastener stringer 18 of FIG. 1 in accordance with the invention, the slide fastener chain is initially positioned within the apparatus with the chain 18 passing through the fine positioning mechanism 58, the die assembly 168, the fastener removing mechanism 60, the gap detecting detecting mechanism 78, and the pulling mechanism 56. Power is applied to the circuitry of FIG. 15 by the power switch 154 being closed. The start switch 270 is momentarily closed to actuate the start relay 266 and close contacts 280 to energize the motors 73 and 158. The relay 266 is maintained in the actuated condition by contacts 282 closing until the step switch 268 or one of the contacts 272 or 274 of the thermoprotective units 278 or 276 open. In a first cycle the manual switch 298 is in a manual or open condition. The fine positioning mechanism 58 is in a retracted position with the switch 146, FIGS. 6 and 7, unoperated to energize the relay 302 which holds contacts 300 and 312 closed. For initiating a first cycle, the push-button switch 334 is momentarily held closed until the press 54 begins to operate. The switch 334 energizes the relays 306 and 314 closing contacts 319 of the relay 306 to energize the valve 320 to advance the fine positioning mechanism 58.

In the fine positioning mechanism of FIGS. 6 and 7 when the air-cylinder 130 is activated, the carriage 134 is advanced. If the teeth 142 and 144 of the pawl 136 are not positioned within interstices between fastening elements 24 and 26, the teeth 142 and 144 slide along the top surface of the elements 24 and 26 until an interstice is reached whereupon the pawl 136 pivots clockwise under the urging of the spring 138 to insert the teeth 142 and 144 into interstices between the elements 24 and 26. Continued advancement of the carriage 134 brings about proper positioning of the slide fastener chain 18 within the die assembly 168 for a cutting operation. The contacts 316 of the relay 314 are closed to permit the switch 146, when the carriage 134 reaches its advanced position, to operate the press trip solenoid 160. Simultaneous with the closing of the contacts 319, the contacts 322 of the relay 306 close to hold the relays 306 and 314 in their operated conditions after the push button switch 334 is released.

The operation of the press trip solenoid 160 permits the crank 152 to cycle through one complete revolution causing the ram 164 to move downward and then back upward. During the downward movement, the teeth 190 and 192 of the cutting blades 176 and 178 cooperate with the surface 228 of the die 208 to sever the longitudinal connecting and supporting members in the inner edges of the tapes 20 and 22 on opposite sides of each of the fastening elements 24 and 26 to be removed. The cuts 194 and 196 thus formed by the teeth 190 and 192 are perpendicular to the longitudinal dimension of the tapes 20 and 22 and parallel to the weft thread segments 38 between the elements 24 and 26. As the cycle of the crank 152 nears its completion, the cam 328 operates the switch 326 which causes the relays 306 and 314 to become deenergized releasing the contacts 316, 319 and 322 to allow the air cylinder 130 in the fine positioning mechanism to detract and releasing the press trip solenoid 160. When the carriage 134 retracts, the switch 146 disengages the contact 318 and engages the contact 308 to operate the relay 302 and bring about the initial energized state of the circuit.

The apparatus can be now changed to automatic operation by setting the counter 297 to a preselected count which causes the switch 296 to close and by closing the manual switch 298 to place the apparatus is the automatic mode. Contacts 300 are held closed by the relay 302 to complete the circuit through the clutch 71 of the slide fastener chain pulling mechanism 58. This drives the wheel 72 causing the slide fastener chain 18 to be pulled through the apparatus to the right as shown in FIG. 3. During this pulling as shown in FIGS. 11, 12, 13 and 14, the chain 18 is pulled through the fastener element removing mechanism 60. The spring blades 240 and 242 engage the elements 24 and 26 causing the elements and segments of longitudinal connecting members which have been cut to be stripped from the chain 18. It is noted that the cuts 194 and 196 are not centered in the interstices between elements but rather are formed at one side of the interstices adjacent to one of each pair of elements which border the interstices in which the cuts are being made. As noted in FIG. 14, having a cut formed adjacent to the elements 24 within the space between that element and the next element results in a short stub 356 of the longitudinal supporting member attached to the element 24 being easily pushed past the weft thread segments or loops 38. Having the longitudinal connecting and supporting members for the fastening elements cut adjacent to the elements rather than centered between the elements results in decreased effort in removing of the elements from the chain since the longitudinal supporting and connecting members have rigidity which would necessitate greater distortion of the weft thread segments 38 during removal of the elements 24.

Additionally it is noted that the removal of the fastening elements is performed during the pulling of the slide fastener chain 18 to the next position. Thus an extra step of removing the elements from the slide fastener chain is not required.

When the gap 42, see FIG. 1, formed by the removed elements reaches the gap sensing mechanism 78, the projection 108 (FIGS. 4 and 5) on the arm 92, which was sliding along the tops of the fastening elements, falls into the gap 42 through the slide fastener chain. Continuing advancement of the chain brings the end of the gap 42 of the chain against the left end of the projection 108 causing the lever 92 to move to the right and actuate the switch 114. Switch 114 operates relays 306 and 314 to then begin another cutting cycle. Operation of the relay 306 also opens contacts 304 in series with the clutch 71 terminating the pulling of the wheel 72 on the chain 18. During the operation of the fine positioning mechanism 58 when the switch 146 is operated, the relay 302 is dectivated causing the contacts 300 in series with the clutch 71 also to open. Operation of switch 146 decrements the counter 297; when the count reaches zero, contacts 296 open preventing a subsequent chain pulling step. Reactivation of the pulling mechanism 56 occurs after the switch 146 is disengaged by the deactivation of the fine positioning mechanism 58 and the switch 326 is operated by the crank cam 328. At the end of the revolution of the crank 152 during the cutting cycle, the operation of the switch 326 also energizes the solenoid valve 332 which in turn operates air cylinder 116, FIG. 4, to pivot the arm 92 clockwise and raise the projection 108 from the gap 42. With the projection removed from the gap 42, the arm 92 is moved to the left as viewed in FIG. 4 so that release of the air cylinder 116 results in the projection engaging the upper surface of the elements past the gap position for sensing the next gap.

Figure 17:
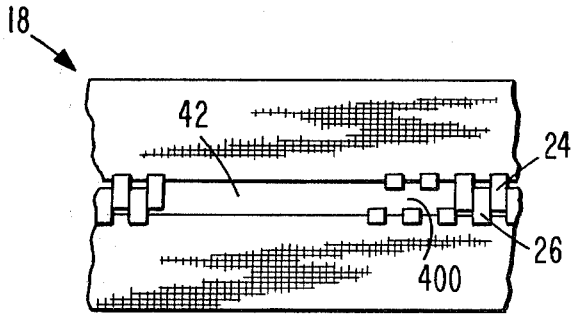
FIG. 17 is a plan view of a slide fastener chain portion gapped by the modified apparatus of FIG. 16.

A modification of the gapping mechanism is shown in FIG. 16 for performing an additional operation on the slide fastener chain 18 as shown in FIG. 17. In this additional operation the head portions of a few of the fastening elements 24 and 26 are cut from the slide fastener chain 18 at the leading end of the gap 42 as shown at 400. In order to sever these head portions at 400, the spacing plate 180 of the cutting assembly is formed to extend past the cutting blades 176 and 178. A punch portion 402 is formed on this extending portion of the spacing blade 180 and a cooperating opening 404 is formed in the die 208 to thus punch the head portions of the fastening elements at 400 from the slide fastener chain 18. It is noted that this punching of the head portions 400 from the elements does not require any additional steps or procedures during the operation of the gapping apparatus.

Since many variations, modifications and changes in detail may be made to the above described embodiments, it is intended that all matter in the foregoing description and shown in the drawings be interpreted as illustrative and not in a limiting sense.

What is claimed is:

1. A method of gapping a slide fastener stringer which has a woven tape and a plurality of spaced fastening elements secured on a longitudinal support member which is secured in the edge of the tape by parallel weft thread segments of the tape extending around the support member between the fastening elements, the method comprising the steps of severing the longitudinal member in the spaces between fastening elements on each side of each of a group of the fastening elements, and pulling the slide fastener stringer longitudinally between opposed biased blades engaging the elements on opposite sides of the slide fastener stringer to strip the group of fastening elements from the tape.

2. A method as claimed in claim 1 wherein the severing of the longitudinal member is performed at one end of the spaces between the fastening elements to produce one severed portion of the longitudinal member on one side of the group of fastening elements substantially shorter than the other severed portion of the longitudinal member.

3. A method as claimed in claim 1 or 2 wherein the severing of the longitudinal member is performed by a cutting member with a plurality of cutting teeth engaging a die to cut the longitudinal member on both sides of each of the group of fastening elements, and there is included the step of fine positioning the group of fastening elements relative to the cutting teeth prior to the severing step by engaging a pawl in an interstice between two adjacent fastening elements and advancing the pawl to a selected position to fine position the group of fastening elements.

4. An apparatus for gapping a slide fastener stringer which has a woven tape and a plurality of spaced fastening elements secured on a longitudinal support member which is secured in the edge of a tape by parallel weft thread segments of the tape extending around the support member between the fastening elements, the apparatus comprising means for severing the longitudinal member on each side of each of a group of the fastening elements, a stripping mechanism including a plurality of opposed biased blades for engaging the elements on opposite sides of the slide fastener stringer, and means for pulling the slide fastener stringer longitudinally between the opposed biased blades of the stripping mechanism for removing the fastening elements from the tape.

5. An apparatus as claimed in claim 4 wherein the severing means includes a severing plate having a plurality of cutting teeth spaced to cut the longitudinal member.

6. An apparatus as claimed in claim 5 wherein the cutting teeth have one side which are vertically straight and an opposite side which are vertically canted, and there is included in the apparatus fine positioning means for positioning the slide fastener stringer so that the cutting teeth cut the longitudinal member adjacent to one side of each of the group of the fastening elements but spaced from the other sides of each of the group of fastening elements.

7. An apparatus for gapping a slide fastener chain which has a pair of woven tapes and a pair of interlocked pluralities of spaced fastening elements molded on a pair of longitudinal support members, respectively, which are secured in the edges of the respective tapes by parallel weft thread segments of the respective tapes extending around the support members between the fastening elements, the apparatus comprising a support, a triggerable press mechanism including a ram, a die assembly mounted on the base of the press mechanism beneath the ram for receiving the slide fastener chain and including a die for supporting the fastening elements, a cutting assembly including a pair of cutting plates and a spacer plate positioned between the cutting plates, the cutting assembly mounted on the bottom of the ram, said cutting blades each having a plurality of cutting teeth extending downward from the cutting plates, said cutting teeth on one of the pair of cutting blades being offset relative to the cutting teeth of the other blade, and said cutting teeth having cutting edges extending perpendicular to the longitudinal dimension of the chain for cooperating with the die of the die assembly to cut the longitudinal support members on each side of each of a group of fastening elements to be removed, fine positioning means mounted on the other side of the press base and including a pawl for engaging interstices of the teeth for determining a fine position of the slide fastener chain in the die assembly beneath the cutting plates, a stripping mechanism mounted on the other side of the press base and including upper and lower members for receiving the slide fastener chain therebetween, said stripping mechanism having respective upper and lower pluralities of spring blades for engaging the upper and lower surfaces of the fastening elements on the slide fastener chain, a rail mounted at one end thereof on the support extending away from the other side of the press mechanism, a gap detecting mechanism mounted on the rail at a selected distance from the press mechanism corresponding to the desired distance between gaps to be formed in the slide fastener chain, a pulling mechanism mounted on the other end of the rail for pulling the slide fastener chain through the fine positioning mechanism, the anvil, the stripping mechanism, and the gap detecting mechanism, and control means for sequentially operating the fine positioning mechanism, the press mechanism and the pulling mechanism and being responsive to operation of the gap detecting mechanism for stopping the pulling mechanism and initiating another cycle.

8. An apparatus as claimed in clam 7 including a punch portion formed on the spacing blade, and wherein said die assembly has a cooperating opening formed therein for cooperating with the punch to sever head portions from a second group of slide fastener fastening elements bordering the group of slide fastener fastening elements to be removed.

* * * * *